United States Patent [19]

Nakazato et al.

[11] Patent Number: 5,041,017

[45] Date of Patent: Aug. 20, 1991

[54] PERFECT COUPLING CONFIRMING MECHANISM FOR AN ELECTRIC CONNECTOR

[75] Inventors: Wataru Nakazato; Kunihiko Muraoka, both of Ohta; Shigemitsu Inaba, Shizuoka; Kazuto Ohtaka, Shizuoka; Takashi Takagishi, Shizuoka, all of Japan

[73] Assignees: Yazaki Corporation; Fuji Jukogyo Kabushiki Kaisha, both of Tokyo, Japan

[21] Appl. No.: 563,375

[22] Filed: Aug. 7, 1990

[30] Foreign Application Priority Data

Aug. 9, 1989 [JP] Japan ..... 1-092951[U]

[51] Int. Cl.[5] ..... H01R 31/08

[52] U.S. Cl. ..... 439/509; 439/513; 439/352

[58] Field of Search ..... 439/188, 507, 509, 510-515, 439/351, 352, 346, 347, 595, 596, 599, 600

[56] References Cited

U.S. PATENT DOCUMENTS

| | | | |
|---|---|---|---|
| 3,869,191 | 3/1975 | Tolnar, Jr. et al. | 339/111 |
| 4,433,888 | 2/1984 | Winger | 339/91 |
| 4,634,204 | 1/1987 | Detter et al. | 439/347 |
| 4,786,258 | 11/1988 | Shaffer et al. | 439/188 |
| 4,806,118 | 2/1989 | Herrmann | 439/352 |
| 4,871,323 | 10/1989 | Ohsumi | 439/347 |
| 4,950,179 | 8/1990 | Takenouchi et al. | 439/352 |
| 4,954,093 | 9/1990 | Nadin | 439/188 |

*Primary Examiner*—David L. Pirlot
*Attorney, Agent, or Firm*—Armstrong, Nikaido, Marmelstein, Kubovcik & Murray

[57] ABSTRACT

A perfect coupling confirming mechanism for an electric connector having a first connector housing and a second connector housing, employing two electrical contactors, among those accommodated in contactor chambers formed in the second connector housing, as check contactors for the confirmation of the perfect coupling of the first and second connector housings. The first connector housing is provided with a principal locking arm provided with a first and second locking projections. A locking slider and a short-circuiting member are provided movably in the second connector housing. When the first and second connector housings are coupled perfectly, the first locking projection and the second connector housing are engaged to lock the first and second connector housings to each other in a primary locked state. In this state, the locking slider is advanced so that the locking slider engages the second locking projection of the principal locking arm to lock the first and second connector housings in a secondary locked state and to disconnect the check contactors electrically by the short-circuiting member. Thus, the first and second connector housings are double-locked. When the first and second connector housings are coupled imperfectly, the locking slider is unable to engage the second locking projection of the principal locking arm and the check contactors remain connected electrically.

5 Claims, 6 Drawing Sheets

PERFECT COUPLING CONFIRMING MECHANISM FOR AN ELECTRIC CONNECTOR

BACKGROUND OF THE INVENTION

1. Field of the Invention

The present invention relates to a perfect coupling confirming mechanism for an electric connector for connecting contactors of an electric circuit on a vehicle.

2. Description of the Prior Art

The electric connector has a pair of connector housings, which are mated together to join electrically the male and female contactors contained therein, and is provided with a locking mechanism to secure the electrical connection of the male and female contactors. In coupling the pair of connector housings by hand, the perfect coupling and exact locking of the pair of connector housings are confirmed through the tactile recognition of coupling, the auditory recognition of locking sound and the visual inspection of the appearance of the electric connector. However, since a large number of electric connectors need to be coupled on the vehicle and the working environment is not necessarily favorable for the sensational confirmation of the perfect coupling of electric connectors, it is possible that some electric connectors are not perfectly coupled.

To improve such a disadvantage, an electrically perfect coupling confirming mechanism as shown in FIGS. 6 and 7 is proposed in Japanese Utility Model Laid-open (Kokai) No. 61-186180. This perfect coupling confirming mechanism comprises a pair of electrical contactors $b_1$ and $b_2$ contained in a first connector housing a in an electrically separate condition, and an elastic tongue e contained in a second connector housing d to bring forcibly the pair of electrical contactors $b_1$ and $b_2$ into contact with each other. The first connector housing a is provided with a protrusion c which prevents the contactors $b_1$ and $b_2$ from the forcible contact when the first connector housing a and the second connector housing d are imperfectly coupled.

This perfect coupling confirming mechanism, however, has the following drawbacks. As shown in FIG. 6, since the pair of electrical contactors $b_1$ and $b_2$ are disposed close to each other in the first connector housing a and any insulating means is not provided between the pair of electrical contactors $b_1$ and $b_2$, it is possible that the electrical contactors $b_1$ and $b_2$ remain in contact with each other before the coupling of the first connector housing a and the second connector housing d when either the electrical contactor $b_1$ or $b_2$ or both the electrical contactors $b_1$ and $b_2$ are deformed or are disposed incorrectly within the first connector housing a. Furthermore, since the elastic tongue e is formed of a synthetic resin integrally with the second connector housing d, the elasticity of the elastic tongue e is dependent on temperature and, under some condition, the elastic tongue e is unable to function properly.

SUMMARY OF THE INVENTION

Accordingly, it is a principal object of the present invention to provide a perfect coupling confirming mechanism for an electric connector, eliminating the foregoing disadvantages of the prior art, employing a pair of electrical check contactors for the confirmation of the perfect coupling of the connector housings, capable of being surely keping electrical disconnection or connection between the check contactors, and capable of double-locking the connector housings when the same are coupled perfectly.

In one aspect of the present invention, a perfect coupling confirming mechanism for an electric connector comprises: a first connector housing provided with a principal locking arm extending rearward in a cantilever fashion from the front end of the upper wall of the first connector housing and provided with a first locking projection in its front half portion, a second locking projection near its rear end and a push-knob at its rear end; a second connector housing to be coupled with the first connector housing, provided with adjacent contactor chambers for accommodating electrical contactors, a first chamber, a second chamber defined by the opposite side walls of the adjacent contactor chambers, and an auxiliary locking arm provided with a locking projection at its front end; a locking slider longitudinally movably inserted in the first chamber of the second connector housing through the rear end of the same and provided with a slot which engages the locking projection of the auxiliary locking arm when the locking slider is advanced to its standby position; a spring biasing the locking slider rearward; adjacent two electrical check contactors accommodated in the adjacent contactor chambers of the second connector housing; and a short circuiting member electrically connecting the adjacent two electrical check contactors when the locking slider is held at the standby position, having a pair of elastic arms capable of projecting through slits formed in the opposite side walls of the adjacent contactor chambers, having contact portions which come into engagement respectively with the adjacent two electrical contactors and operating projections at their extremities, respectively, held on the locking slider in the second chamber of the second connector housing for movement together with the locking slider.

The first locking projection of the principal locking arm of the first connector housing and the second connector housing are engaged to lock the first and second connector housings to each other in a primary locked state when the first and second connector housings are coupled perfectly, the locking slider and the second locking projection of the principal locking arm of the first connector housing are engaged when the first and second connector housings are coupled perfectly and the locking slider is advanced from the standby position against resilience of the spring to lock the first and second connector housings to each other in a secondary locked state and to disconnect the contact portions of the short-circuiting member from the adjacent two electrical check contactors so that the adjacent two electrical check contactors are disconnected electrically, and insulating walls are formed on the opposite side walls of the adjacent contactor chambers in front of the slits to insulate the contact portions of the short-circuiting member from the adjacent two electrical check contactors, respectively, when the first and second connector housings are coupled perfectly.

The first connector housing and the auxiliary locking arm of the second connector housing are engaged to lock the first and second connector housings to each other in the primary locked state when the first and second connector housings are coupled perfectly; the locking slide longitudinally slidably inserted in the second connector housing, biased backward by the spring and held in place in the second connector housing is able to engage the second locking projection of the principal locking arm of the first connector housing only when the first and second connector housings are coupled perfectly.

Thus, the first and second connector housings are double-locked, when coupled perfectly, by means of the locking arms and the locking slider to prevent the imperfect coupling of the first and second connector housings.

The contact portions of the pair of elastic arms of the shortcircuiting member held on the locking slider are in contact with the adjacent two electrical check contactors to connect the adjacent two electrical check contactors electrically when the locking slider is held at the standby position, and the contact portions are separated from the adjacent two electrical check contactors to disconnect the adjacent two electrical check contactors electrically from each other when the first and second connector housings are coupled perfectly to allow the locking slider to engage the second locking projection of the principal locking arm for secondary locking. Thus, it is possible to test if the first and second connector housings are coupled perfectly by connecting the second connector housing provided with the adjacent two electrical check contactors to a check circuit provided with an alarm lamp or a buzzer.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENT

Figure 1:
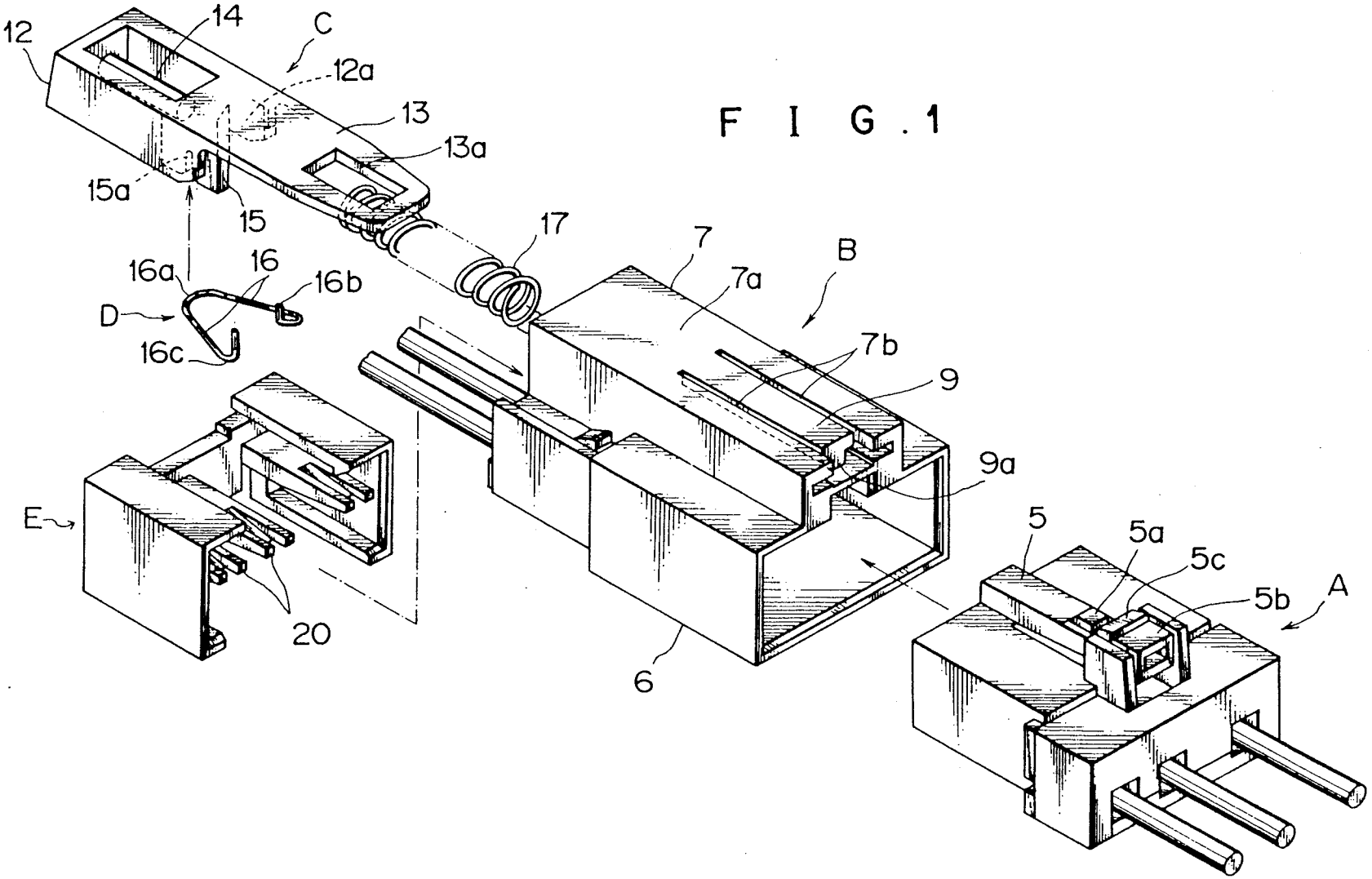
FIG. 1 is an exploded perspective view of a perfect coupling confirming mechanism for an electric connector in a preferred embodiment according to the present invention.
Figure 2:
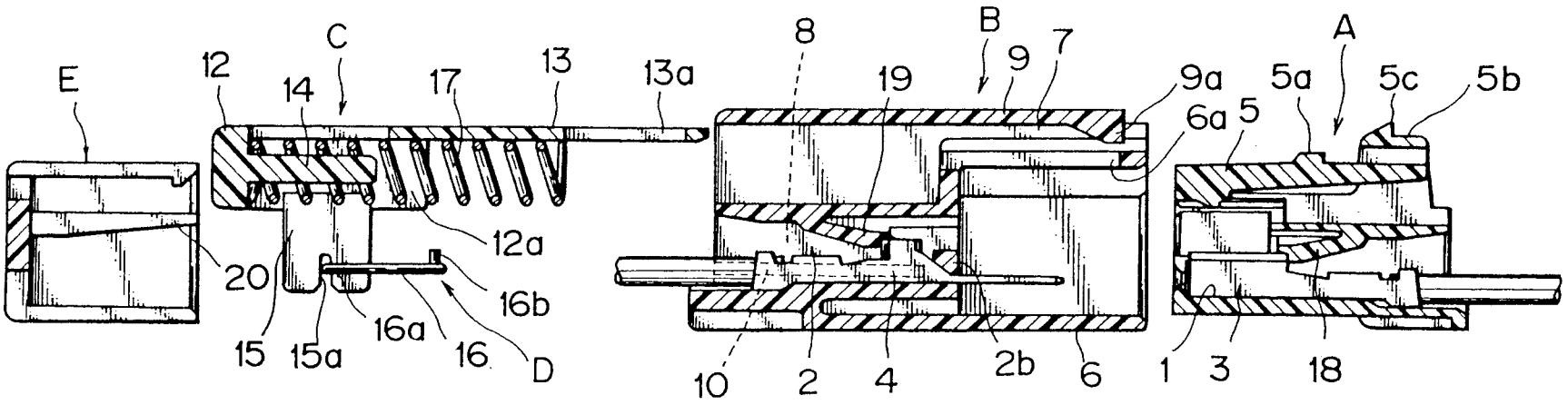
FIG. 2 is a sectional view of the perfect coupling confirming mechanism of FIG. 1.

Referring to FIGS. 1 and 2, there are shown a first connector housing A formed of a synthetic resin, a second connector housing B formed of a synthetic resin, a locking slider C formed of a synthetic resin, and a short-circuiting member D formed of an elastic metallic wire and connected to the locking slider C.

The first connector housing A is provided internally with a plurality of contactor chambers 1 fixedly holding female electrical contactors 3 in place, and the second connector housing B is provided internally with a plurality of contactor chambers 2 fixedly holding male electrical contactors 4 respectively corresponding to the female electrical contactors 3 in place. A principal locking arm 5 extends to the rear in a cantilever fashion from the front end of the outer surface of the upper wall of the first connector housing A. The principal locking arm 5 is provided with a first locking projection 5*a* in its front half portion, a second locking projection 5*c* near its rear end, and a push-knob 5*b* at its rear end. A hood 6 for receiving the front portion of the first connector housing A is formed in the front half of the second connector housing B, and a slot 6*a* for receiving the first locking projection 5*a* of the principal locking arm 5 is formed in the upper wall of the hood 6. The second connector housing B is provided with a first chamber 7 for accommodating the locking slider C, and a second chamber 8 for accommodating the short-circuiting member D. The first chamber 7 extends from the rear end of the second connector housing B to the front end of the hood 6 so as to surround the slot 6*a*. Two slits 7*b* are formed in the front portion of the upper wall 7*a* of the second connector housing B to form an auxiliary locking arm 9. The auxiliary locking arm 9 is provided with a locking projection 9*a* on the front end of its lower surface. The second chamber 8 is defined by the side walls 2*a* of the adjacent contactor chambers 2 for accommodating the male electrical contactors 4. Slits 10 are formed respectively in the adjacent side walls 2*a* so that elastic arms 16 of the short-circuiting member D are able to project into the adjacent connector chambers 2, respectively. The respective front portions of the opposite side surfaces of the adjacent side walls 2*a* are inclined toward each other to taper the second chamber 8 toward the front by inclined guide surfaces 11 for guiding operating projections 16*b* of the short-circuiting member D. Insulating walls 2*b* are formed in front of the inclined guide surfaces 11 to insulate the elastic arms 16 from the male electrical contactors 4 accommodated in the adjacent contactor chambers 2.

A locking finger 13 of the locking slider C extends to the front from a body 12 having the shape of a channel, and is provided with a slot 13*a* for receiving the locking projection 9*a* of the auxiliary locking arm 9. The body 12 is provided therein with a spring guide pin 14. A holding projection 15 provided with a recess 15*a* for holding the short-circuiting member D projects vertically from one of the side walls 12*a* of the body 12.

The short-circuiting member D is formed by bending an elastic metallic wire. The pair of elastic arms 16 extend obliquely away from each other from a junction 16*a*. The elastic arms 16 are able to bend elastically about the junction 16*a*. The free ends of the elastic arms 16 are bent inward to form contact portions 16*c* which come into contact with the side surfaces of the adjacent two male electrical contactors 4. The extremities of the elastic arms 16 are bent upright to form the operating projections 16*b*.

A compression coil spring 17 is mounted on the spring guide pin 14 of the locking slider C. The first connector housing A and the second connector housing B are provided with flexible stopping fingers 18 and 19 in the connector chambers 1 and 2, respectively, to hold the female electrical contactors 3 and the male electrical contactors 4 in place. A rear holder E having a plurality of holding fingers 20 is inserted in the rear end of the second connector housing B and is locked in place by known locking means to hold the male electrical contactors 4 in place in the second connector housing B for double-fixing effect.

Figure 3A:
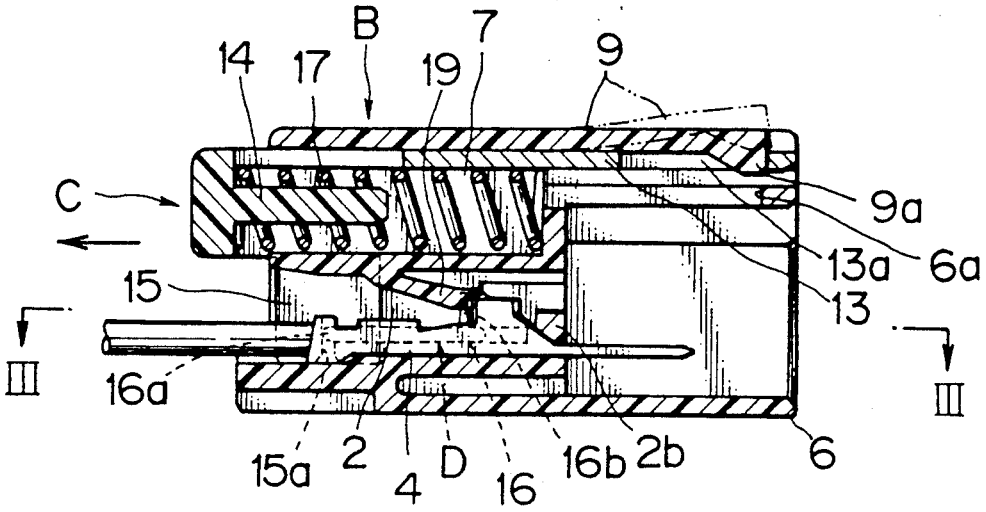
FIG. 3A is a sectional view of a second connector housing employed in the perfect coupling confirming mechanism of FIG. 1, in which a locking slider is held at a standby position.
Figure 3B:
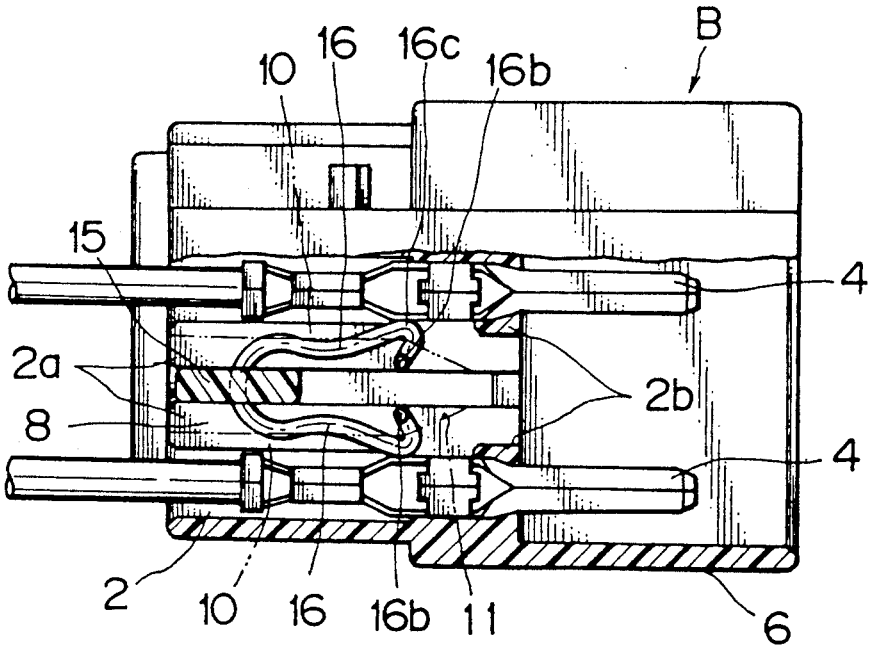
FIG. 3B is a sectional view taken on line III—III in FIG. 3A.

Referring to FIG. 3A, the male electrical contactors 4 accommodated in the contactor chambers 2 of the second connector housing B are held in place by flexible stopping fingers 19, so that the male electrical contactors 4 are unable to come off the second connector housing B. When the locking slider C with the coil spring 17 mounted on the spring guide pin 14 is inserted in the first chamber 7, the auxiliary locking arm 9 is bent up temporarily as indicated by alternate long and two short dashes lines by the advancing locking finger 13. Upon the engagement of the slot 13*a* of the locking finger 13 and the locking projection 9*a*, the auxiliary locking arm 9 restores its original shape elastically to hold the locking slider C at the standby position in the first chamber 7. In this state, the locking slider C is biased continuously rearward as indicated by an arrow by the compressed coil spring 17. In inserting the locking slider C in the first chamber 7, the short-circuiting member D is held at the junction 16*a* in the recess 15*a* of the holding projection 15 and is inserted in the second chamber 8. As shown in FIG. 3B, the pair of elastic arms 16 of the short-circuiting member D project through the slits 10 formed in the opposite side walls 2*a* of the adjacent contactor chambers 2 into the adjacent contactor chambers 2, and the bent portions 16*c* are in contact with the side surfaces of the adjacent two male electrical contactors 4, respectively to short-circuit the adjacent two male electrical contactors 4. In this state, the operating projections 16*b* of the short-circuiting member D are located near the starting ends of the inclined guide surfaces 11 and are not in contact with the inclined guide surfaces 11. Naturally, the male electrical contactors 4 may be inserted in the contactor chambers 2 after inserting the locking slider C in the first chamber 7 and holding the same at the standby position.

Figure 4A:
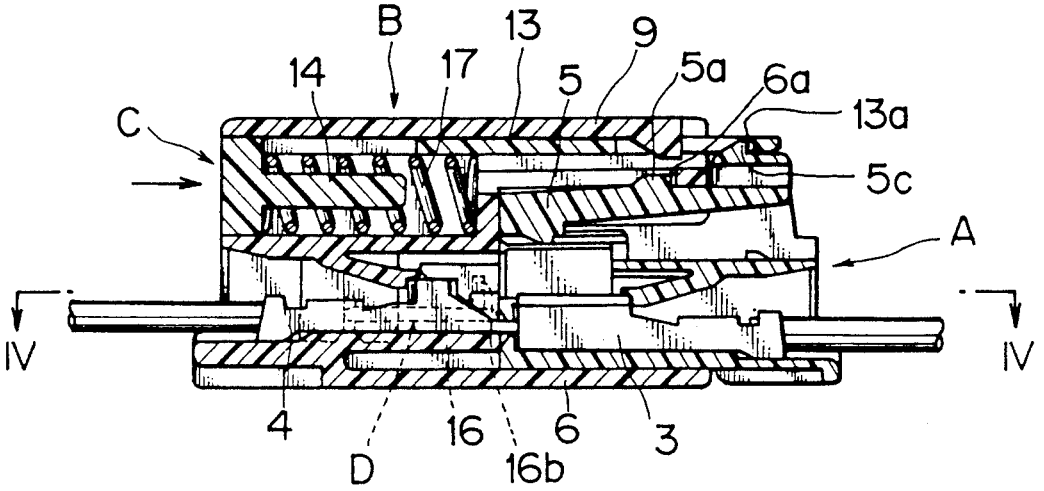
FIG. 4A is a sectional view of the perfect coupling confirming mechanism of FIG. 1, in which the first and second connector housings are coupled.

Referring to FIG. 4A, the first connector housing A is inserted in the hood 6 of the second connector housing B to couple the first connector housing A and the second connector housing B. If the first connector housing A and the second connector housing B are coupled perfectly, the first projection 5*a* of the principal locking arm 5 of the first connector housing A engages the slot 6*a* of the second connector housing B to lock the first connector housing A and the second connector housing B to each other in a single-locked state. In this state, the electrical connection of the female electrical contactors 3 and the corresponding male electrical contactors 4 is achieved perfectly.

Figure 4B:
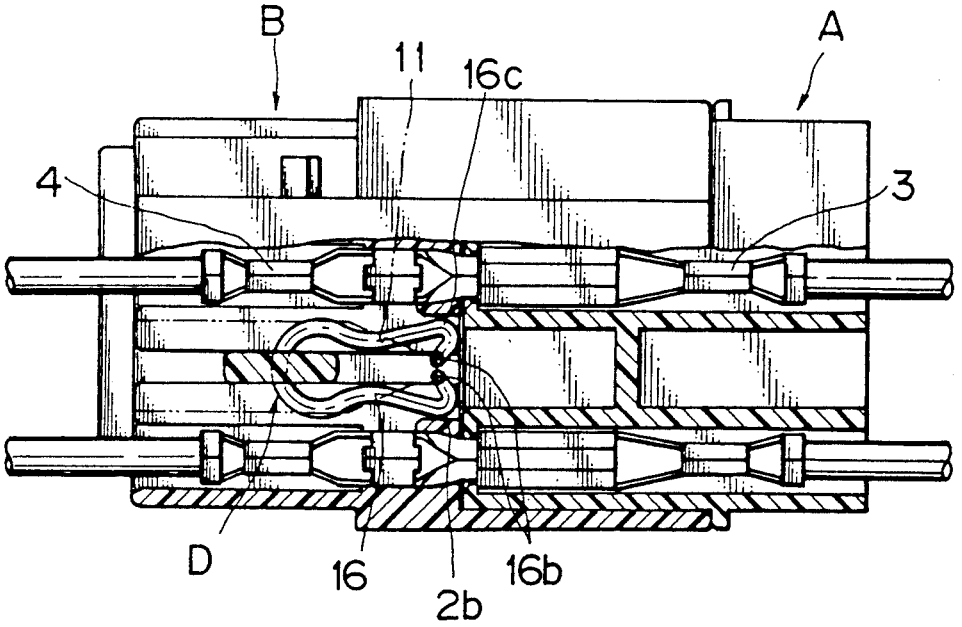
FIG. 4B is a sectional view taken on line IV—IV in FIG. 4A.

Then, the locking slider C is advanced against the resilience of the coil spring 17 as indicated by an arrow and, eventually, the second locking projection 5*c* of the principal locking arm 5 engages the slot 13*a* of the locking slider C to hold the locking slider C in place, whereby the first connector housing A and the second connector housing B are locked to each other in a double-locked state. At the same time, the operating projections 16*b* of the short-circuiting member D are moved forcibly toward each other by the inclined guide surfaces 11 as the short-circuiting member D advances together with the locking slider C, whereby the contact portions 16*c* of the short-circuiting member D are separated from the adjacent two electrical contactors 4 to disconnect the adjacent two electrical contactors 4 electrically as shown in FIG. 4B, in which the operating projections 16*b* are at the ends of the inclined guide surfaces 11, where the distance between the inclined guide surfaces 11 is the smallest, and the contact portions 16*c* are insulated perfectly from the adjacent two electrical contactors 4, respectively.

If the locking slider C is not advanced properly, the locking slider C is returned to its standby position by the coil spring 17. If the first connector housing A and the second connector housing B are coupled imperfectly, the second locking projection 5*c* of the first connector housing A is unable to engage the slot 13*a* of the locking finger 13 of the locking slider C, and hence the locking slider C is returned to its standby position by the coil spring 17. In either case, the locking slider C is returned to its standby position as shown in FIGS. 3A and 3B and the adjacent two electrical contactors 4 remains connected.

Figure 5A:
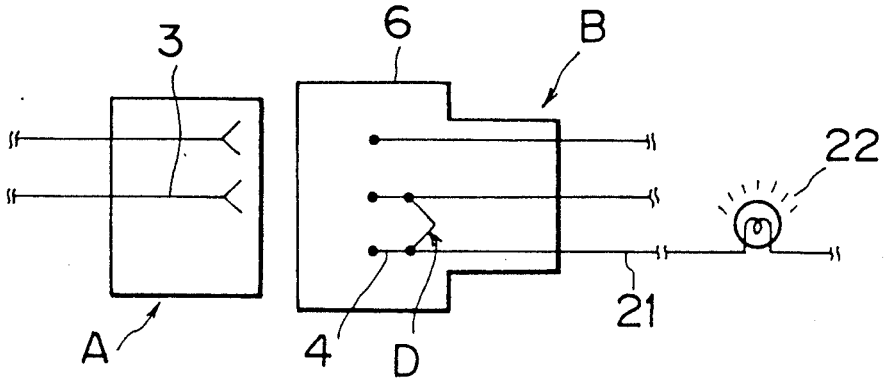
FIGS. 5A and 5B are connection diagrams showing the status of a check circuit before and after, respectively, perfectly coupling the first and second connector housings.
Figure 5B:
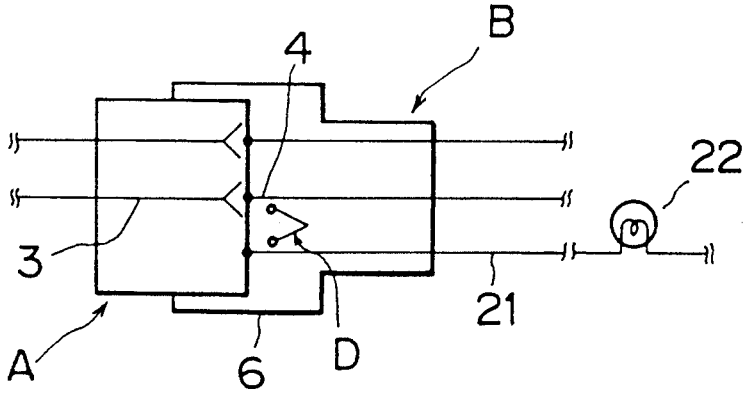
Figure 6:
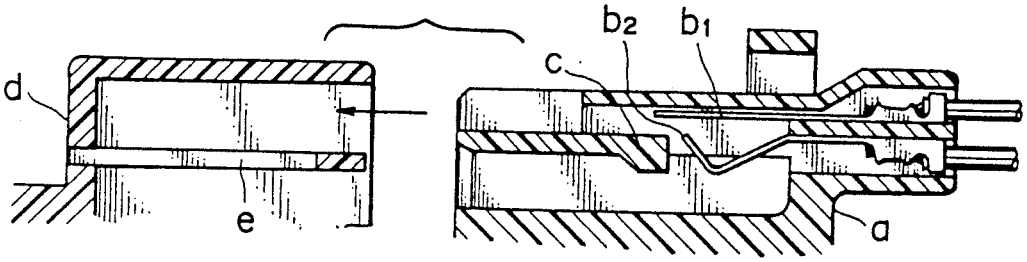
FIG. 6 PRIOR ART
FIG. 6 is a fragmentary sectional view of a conventional perfect coupling confirming mechanism in a state where first and second connector housings are separated.
Figure 7:
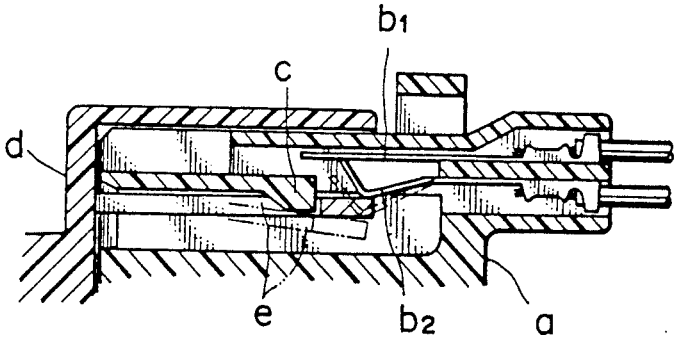
FIG. 7 PRIOR ART
FIG. 7 is a fragmentary sectional view of the conventional perfect coupling confirming mechanism of FIG. 6 in a state where the first and second connector housings are coupled.

FIGS. 5A and 5B show a check circuit for checking the coupling of the first connector housing A and the second connector housing B. In a state shown in FIG. 5A, the first connector housing A and the second connector housing B are separated from each other, the locking slider C is at its standby position, and the adjacent two electrical contactors 4 are short-circuited by the short-circuiting member D to make the check circuit 21, so that an alarm lamp 22 is switched on. In a state shown in FIG. 5B, the first connector housing A and the second connector housing B are coupled perfectly in the double-locked state, in which the adjacent two electrical contactors 4 are disconnected to break the check circuit 21, and hence the alarm lamp 22 is switched off.

Thus, the perfect coupling of the first connector housing A and the second connector housing B in the double-locked state can be confirmed by checking the condition of the adjacent two electrical contactors 4. Accordingly, it is possible to see exactly if the connector housings A and B are coupled perfectly without depending on auditory, tactile or visual sensation. Since the short-circuiting member D is accommodated in the second chamber 8 insulated from the contactor chambers 2 accommodating the adjacent two electrical contactors 4, and the contact portions 16*c* of the elastic arms 16 are insulated from the adjacent two electrical contactors 4 by the insulating walls 2*b* when the connector housings A and B are coupled perfectly, the adjacent two electrical contactors 4 are never short-circuited accidentally by the short-circuiting member D, and the short-circuiting member D is never deformed.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A perfect coupling confirming mechanism for an electric connector, comprising:

a first connector housing provided with a principal locking arm extending rearward in a cantilever fashion from a front end of an upper wall of the first connector housing and provided with a first lock projection in a front half portion, a second lock projection near its rear end;

a second connector housing to be coupled with the first connector housing, provided with adjacent contactor chambers for accommodating electrical contactors, a first chamber, a second chamber defined by opposite side walls of the adjacent contactor chambers, and an auxiliary locking arm provided with a locking projection at its front end;

a locking slider longitudinally movably inserted in the first chamber of the second connector housing through a rear end of the same and provided with a slot which engages the locking projection of the auxiliary locking arm when the locking slider is advanced to a standby position;

a spring biasing the locking slider rearwardly;

two adjacent electrical check contactors accommodated in the adjacent contactor chambers of the second connector housing; and a short-circuiting member electrically connecting the adjacent two electrical check contactors when the locking slider is held at the standby position, having a pair of elastic arms capable of projecting through slits formed in the opposite side walls of the adjacent contactor chambers, and having contact portions which come into engagement respectively with the adjacent two electrical check contactors, held on the locking slider in the second chamber of the second connector housing for movement together with the locking slider;

wherein the first locking projection of the principal locking arm of the first connector housing and the second connector housing are engaged to lock the first and second connector housings to each other in a primary locked state, the locking slider and the second locking projection of the principal locking arm of the first connector housing are engaged and the locking slider is advanced from the standby position against resilience of the spring to lock the first and second connector housings to each other in a secondary locked state and to disconnect the contact portions of the short-circuiting member from the adjacent two electrical check contactors, and insulating walls are formed on the opposite side walls of the adjacent contactor chambers in front of the slits to insulate the contact portions of the short-circuiting member from the adjacent two electrical check contactors, respectively, when the first and second connector housings are coupled perfectly.

2. A perfect coupling confirming mechanism according to claim 1, wherein front portions of the surfaces of the opposite side walls of the adjacent contactor chambers are inclined toward each other to form inclined guide surfaces, respectively, and the operating projections formed at extremities of the elastic arms of the short-circuiting member slide along the inclined guide surfaces, respectively, as the locking slider advances from its standby position to a locking position to separate the contact portions of the short-circuiting member from the adjacent two electrical check contactors.

3. A perfect coupling confirming mechanism for an electric connector comprising:

a plurality of electrical contactors accommodated in first and second connector housing;

a principal locking arm formed in said first connector housing having a first lock projection formed therein to engage with said second connector housing when said first and second connector housings are coupled;

a locking slider longitudinally slidable within said second connector housing and urged rearwardly therewithin, said principal locking arm of the first connector housing having a second lock projection, said locking slider having a slot therein adapted to engage with said second lock projection of the principal locking arm of the first connector housing when said locking slider is pressed forward against said urge;

a short-circuiting member attached to said locking slider to electrically connect adjacent two members of said plurality of electrical contactors accommodated in the second connector housing when said locking slider takes a first position under said urge within said second housing;

means for disconnecting said short-circuiting member with said adjacent two members of said plurality of electrical contactors when said locking slider is further inserted forwardly to take a second position such that said slot in the locking slider is engaged with said second lock projection of the principal locking arm of the first housing.

4. A perfect coupling confirming mechanism for an electric connector as claimed in claim 3, wherein said short-circuiting member comprises a pair of elastic arms capable of projecting through slits formed in opposite side walls of chambers to accommodate said adjacent two members of the plurality of electrical contactors, and two contact portions which come into engagement respectively with said two members of the plurality of electrical contactors when said locking slider takes the first position under said urge within said second housing, and are disconnected from said two members of the plurality of electrical contactors by insulating walls formed on said opposite side walls of said chambers to accommodate said adjacent two members of the plurality of electrical contactors when said locking slider is further inserted forward to take the second position.

5. A perfect coupling confirming mechanism for an electric contactor as claimed in claim 4, wherein front portions of said side walls of chambers to accommodate said adjacent two members of the plurality of electrical contactors are inclined toward each other to form inclined guide surfaces, respectively, and operation projections provided at extremities of the elastic arms of the short-circuiting member slide along said inclined guide surfaces, respectively, to disconnect said two contact portions from said two members of the plurality of electrical contactors by said insulating walls as said locking slider is further inserted from the first position to the second position.

* * * * *